United States Patent [19]

Damour

[11] 4,332,356

[45] Jun. 1, 1982

[54] CHUCK FOR SIMULTANEOUSLY WINDING A PLURALITY OF NARROW PRODUCT STRIPS ON CORES

[76] Inventor: Lawrence R. Damour, 16 Chesler Sq., Succasunna, N.J. 07876

[21] Appl. No.: 236,673

[22] Filed: Feb. 23, 1981

[51] Int. Cl.[3] ..... B65H 75/18

[52] U.S. Cl. ..... 242/72 B; 242/56.9

[58] Field of Search ..... 242/72 B, 72, 72.1, 242/56.9; 279/2 R, 2 A; 269/48.1

[56] References Cited

U.S. PATENT DOCUMENTS

| | | | |
|---|---|---|---|
| 3,010,671 | 11/1961 | Brown | 242/72 B |
| 3,825,167 | 7/1974 | Komorek | 242/72 B |
| 3,853,280 | 12/1979 | Pennisi | 242/72 B |
| 3,917,187 | 11/1975 | Damour | 242/72 B |
| 3,937,412 | 2/1976 | Damour | 242/72 B |
| 4,124,173 | 11/1978 | Damour | 242/72 B |
| 4,209,138 | 6/1980 | Cecchi | 242/56.9 |
| 4,220,291 | 9/1980 | Papa | 242/56.9 |

*Primary Examiner*—Edward J. McCarthy
*Attorney, Agent, or Firm*—Ralph R. Roberts

[57] ABSTRACT

There is provided apparatus in the form of a chuck that is adapted for winding a plurality of strips of material on narrow cores with the build-up of strip windings being regulated by an adjustment of pressurized air or fluid into a resilient tube in the chuck. The chuck includes a plurality of movable leaves and fixed separators carried on an inner core. The leaves are retained against excessive outward movement by cooperative longitudinal edge retaining means provided on and by the fixed separators. The resilient tube is carried in a groove formed in the inner support member and this tube supports and moves a plurality of saddle members each of which carries at least one drive member. Each leaf is formed with a plurality of shallow grooves so that when the pressurized air or fluid is fed to the resilient tubes the movable leaf members and drive members carried therewith are moved outwardly to provide restraining shoulders and drive means for the narrow core, and release of the pressure on said resilient tube allows the leaf members and drive members to move into a condition and position whereat the narrow cores may be removed from the chuck and replaced.

15 Claims, 6 Drawing Figures

CHUCK FOR SIMULTANEOUSLY WINDING A PLURALITY OF NARROW PRODUCT STRIPS ON CORES

BACKGROUND OF THE INVENTION

1. Field of the Invention

With reference to the classification of art as established in and by the United States Patent Office the present invention is believed to be found in the general class entitled, "Winding and Reeling" (Class 242) and in the subclass therein entitled, "Multiple Reel—simultaneous operation " (Subclass 56.9) and in the subclass entitled, "Contractable or Expansible—With Inflatable means" (Subclass 72 B)

2. Description of the Prior Art

Expanding mandrels adapted to hold and release cores of strip material that is to be wound are well known. In particular the use of pneumatics for expanding the movable leaf portions into and from a gripping condition is shown in Applicants prior U.S. Pat. No. 3,825,167 as issued July 23, 1974; 3,917,187 as issued Nov. 4, 1975; 3,937,412 as issued Feb. 10, 1976 and 4,124,173 as issued Nov. 7, 1978. Also to be noted in U.S. Pat. No. 4,220,291 to PAPA as issued Sept. 2, 1980. These and other attempts to wind a plurality of narrow strips of material on cores contemplate a build-up and needed slip to accommodate the changes in the diameter of the winding of the strips. Said slip control resulted in some strips having too much tension and some strips having not enough tension to produce the desired winding result.

U.S. Pat. No. 4,220,291 to PAPA discloses an expandible chuck much like that of Applicants apparatus above identified but proposes to apply very localized pressure on narrow cores by applying pressure through balls carried in conical apertures. The ball concept does not provide positive driving ability when the spools are mounted. In fact, at the outset of winding at core diameter there is no positive drive and certainly not at the diameter of the finished strip. When tried, balls have proved to be too localized and have a tendency to rotate. The tapered receiving apertures to retain these balls tend to become oversize and/or worn to the extent that the balls fall from said formed apertures after a short use. The present invention is a modification of Applicant's U.S. Pat. No. 3,825,167 and includes hardened and replaceable button end members which are carried by support saddles that rest upon and are moved by pneumatically actuated tubing.

SUMMARY OF THE INVENTION

This invention may be summarized, at least in part, with reference to its object. It is an object of this invention to provide, and it does provide, an expanding chuck for winding a plurality of strips on cores of like size. Usually these cores are of like width and there is a similar and like chuck or spindle to accommodate the other strips that are produced when sheeting is slit to provide a plurality of narrow alternate strips.

In the drawing and the description of the chuck it is to be noted that the diameter of the chuck or spindle and the grooves formed therein are made to accommodate particular spools and cores. The chuck includes a plurality of leaves with grooves adapted to restrain the cores when the leaves are expanded by pneumatic pressure. The grooves in the movable leaves are selectively sized to retain the cores on which the strips are wound.

Each groove has one or more button-like member having hardened head portions with these button-like members carried by short support saddle portions that are engaged by and lie in grooves carrying a resilient and expandible tube. Preferably this tube is disposed longitudinally but may be spirally arrayed if desired.

Each chuck has at least three movable leaf or jaw portions and as shown in U.S. Pat. Nos. 3,825,167 and 3,917,187 above identified, have retaining means to prevent loss of these movable leaf members during use and change. These grooves for cores are shallow but may cause or encourage distortion in said members so there is shown additional screw securing means. The receiving grooves at the area containing the movable leaf or jaw members have one or more counterbored apertures for slidably retaining the button-like drive members. Each drive member is seated and retained in a short saddle-like strip portion which rests on and is moved by and with an expanded tube.

In operation the cores are retained but slidable in the formed grooves. The leaf members in the collapsed condition are sufficiently retracted to permit the empty and filled cores to be slid from the chuck. In the expanded condition the leaf members retain the cores in the formed grooves and further pneumatic pressure causes the saddle strip portion to move outwardly carrying the hardenend head portions into contact with the inner surface of the cores. These cores are engaged by said head portions to drive the cores with relative rotation and also with sufficient slip to accommodate the build-up in diameter of the wound strip on the cores. It is anticipated that pressurized air will be utilized to build up the driving force as the diameter of the wound strip is increased. The hardened head portions are subject to wear since the cores are extremely abrasive when the cores are paper or cardboard and the slip is quite extensive. The chuck is easily disassembled and the worn button-like members are removed and replaced with and by like but new members.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of a chuck for simultaneously winding narrow strips of material on cores as adopted for use with an expandable drive means and showing a preferred means for constructing and employing this drive in said chuck. This specific embodiment has been chosen for the purposes of illustration and description as shown in the accompanying drawing wherein:

BRIEF DESCRIPTION OF THE DRAWING

In the following description and in the claims various details are identified by specific names for convenience. These names are intended to be generic in their application. Corresponding reference characters refer to like members through out the several figures of the drawing.

ASSEMBLY OF THE CHUCK AS IN FIG. 1

Figure 1:
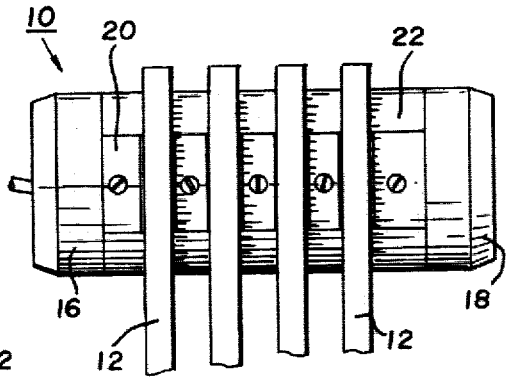
FIG. 1 represents a side view, partly diagrammatic, of a chuck assembly for winding narrow product strips on cores.

Referring next to the drawing and in particular to FIG. 1, there is depicted an assembled chuck generally identified as 10 and the strips of thin material and the like which are wound with alternate spacing provided. These alternate material strips, although not shown, are wound on a separate and like chuck assembly. The wound strips are identified as 12 and are attached to removable cores 14 seen in FIG. 2. The chuck assembly has front and rear end caps 16 and 18 which retain the movable leaf members 20 which are usually three in number. These movable leaf members are retained by fixed separators 22 also secured to the end caps 16 and 18 as explained in detail in Applicants prior identified, U.S. Pat. No. 3,825,167 and to the extent applicable included by reference in this application.

SECTIONAL ASSEMBLY AS IN FIG. 2

Figure 2:
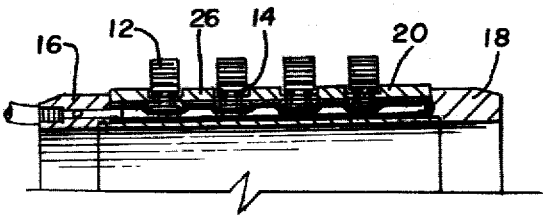
FIG. 2 represents a sectional side view, partly fragmentary and diagrammatic, and showing chuck construction and the winding of narrow strips on cores.

In FIG. 2, the chuck 10 is shown with end caps 16 and 18 retaining the leaf member 20. With very small diameter chucks (less than two inches in diameter) there may be as few as two expansible leaves. Large diameters probably have not more than four leaf members and there are as many fixed separators as movable leaves 20. As seen, the wound strips 12 are carried by and on cores 14 which are usually cardboard since cores are usually disposable. Each movable leaf member 20 is formed with a plurality of shallow grooves 26 which are sized to slidably retain the cores 14 so as to prevent unwanted sideway travel or movement when mounted on the chucks outer diameter. Also seen in this FIG. 2 is an inlet conductor 28 which is connected to a resilient tube 30 seen in greater detail and in larger scale in later described figures.

SECTIONAL VIEW AS IN FIG. 3

Figure 3:
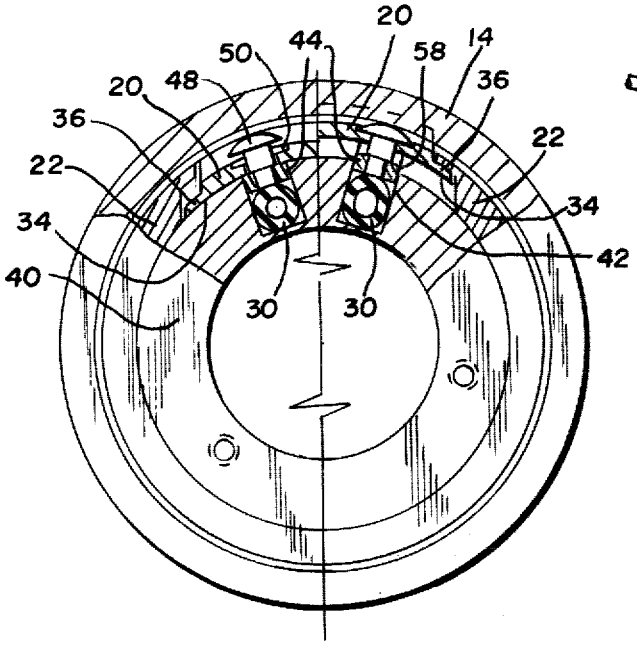
FIG. 3 represents an enlarged end view, partly in section and partly diagrammatic, and showing expandable leaf portions, one in a collapsed and one in an expanded condition so as to drive the core for winding the strip.

Referring next to the partly diagrammatic end view of FIG. 3, the chuck is shown in an assembled condition with the left sectional portion showing a leaf member 20 in the inner condition whereat the core 14 is slid onto the chuck. The leaf member 20 as seen in the left sectional portion or view is retained by a fixed separator 22. As shown in Applicant's U.S. Pat. No. 3,825,167 above referenced, the leaf member 20 has an outwardly extending edge portion or shoulder which is slidable outwardly and restrained and retained from unwanted and excessive outward movement by an inwardly extending lip or shoulder 36. The inner portion of this chuck includes an inner member 40 in which there are formed grooves 42 in which the resilient and/or rubber tube 30 is placed.

Disposed along each groove 42 are saddle members 44 which are slidable in each groove and are moved outwardly with the expansion of the resilient tube 30. Each saddle has one or more apertures 46 in which are removably mounted the reduced shank end portion 47 of a button-like drive member 48. The head portion of each button-like member is adapted to seat in a counter bore 50 formed in the leaf member 20. In the expanded condition, as depicted in the right sectional view position the resilient tube 30 is shown inflated and the saddle member 44 has been moved outwardly. The movable leaf member 20 also has moved outwardly to the limit established by the cooperating shoulders 34 and 36. The outward button end or ends of drive member 48 engage the inner diameter of core 14 to drive said core with a controlled slip.

EMBODIMENT AS IN FIGS. 4 A AND 4 B

Figure 4A:
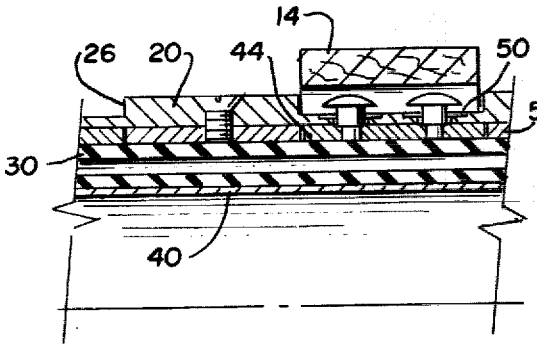
FIGS. 4 A and 4 B represent fragmentary side sectional views of a core member and driving button-like members in both the retracted and in drive conditions.
Figure 4B:
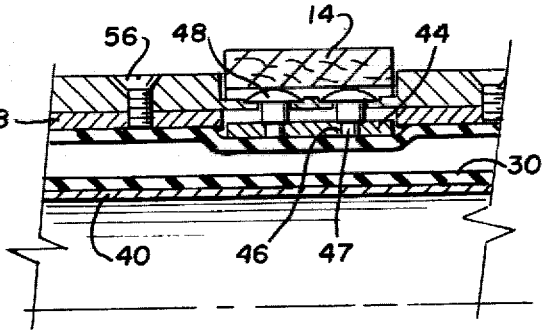

The partly fragmentary and enlarged side sectional views of FIGS. 4 A and 4 B depict the operation and preferred construction of the chuck assembly for this invention. In FIG. 4 A the resilient tube 30 is in the non-expanded condition. Grooves 42 are formed in the inner member 40 and as shown are longitudinally disposed rather than spirally wound. The arrangement of the tube is merely a matter of convenience of construction as spiral winding using only one resilient tube can be provided. The heads of the button-like drive members 48 are spaced to enter and be movable in the grooves 26 formed in the movable leaf member 20. As shown, the outer leaf portion has grooves formed therein and attached as by flat headed screws are saddle strip segments 58. These segments provide a filler in the groove portion 42 of member 40. Said segment strips 58 are moved by the expanding of tube 30 and in turn move leaf member 20 outwardly.

In FIG. 4 B the cardboard core 14 is longitudinally retained in grooves 26. The resilient tube 30 has been expanded by the application of pressurized air and the like and this expanded tube moves saddle members 44 outwardly and carries the button-like drive members into driving engagement with the core 14. The expansible resilient tube also carries the saddle strips 58 and attached leaf members outwardly to provide the restraining groove shoulder 26 for the core.

The depiction of FIGS. 4 A and 4 B are also shown in the sectional and diagrammatic showing of FIG. 3. In use, the cores 14 are placed on the chuck to correspond to the grooves 26. The chuck shaft is then rotated by the usual means. Pressurized air or fluid is fed to the inlet conductor 28 and as seen in FIG. 3 (right side) and in FIG. 4 B, the drive members 48 are moved outwardly to engage the inner diameter of the narrow cores 14 to drive said cores at the desired speed. Slip is needed for these cores to accommodate the build-up of material on the cores. Since the material and winding of each strip are substantially identical the increase or decrease in the pressurized fluid achieves a desired slip.

The slip of the button-like head portion 48 on the inner diametrical surface of a core induces wear and after a certain amount of wear the drive members 48 are replaced. It is anticipated that these drive members are of hardened steel but the use of plated or coated heads is also contemplated. The reduced diameter on the shank end allows replacement with predetermined extension of the drive member 48 above the reduced shank end 47.

EMBODIMENT OF FIG. 5

Figure 5:
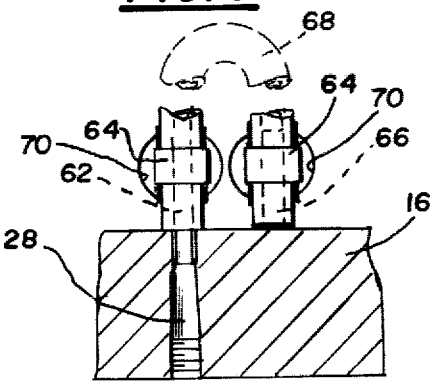
FIG. 5 represents a fragmentary side view and showing the end of the chuck with the expansible resilient and/or rubber tubing with one end of the tube secured to an outer conduit and the other end shown having an inner plug member with both ends sealed and secured with clamps.

The showing in FIG. 5 is merely a suggestion of the arrangement for the mounting and use of a resilient tube 30. The end cap 16 is shown with an inlet conductor 28 which is secured to a conductor, not shown. This inlet is arranged for a short connector 62 which is depicted as a short length of tubing. Said short connector 62 may be retained to end cap 16 or alternately the connector 62 may extend through end cap 16 and have said connector attached to a source of air. Whatever the means for connecting the resilient tube 30 to the connector 62, a clamp 64 retains the tubing to the connector 62. The tubing is then laid in the grooves 42 in a serpentine manner. The end of the tubing 30 is brought adjacent to end cap 16 and a resilient plug 66 is entered into this end and a clamp 64 secures said end to prevent an unwanted escape or leak of pressure. Any increase or decrease in pressure in the tubing 30 is through the single inlet 28. The single tubing provides an even distribution of pressure and also eliminates potential leakage points. The serpentine arrangement is shown with a U-bend at each end as suggested in phantom outline in FIG. 5. Said U-bend is designated as 68 and provides the redirection for each length of tube 30. Reliefs 70 are made in the inner member 40 so that clamps 64 do not cause adjacent tube portions 30 to lay out of the groove 42. Short connector 62 or plug 66 enables the resilient tubing 30 to bridge a relief 70.

The chuck above described may have as few as two movable leaves and in larger sizes may have as many as four or in rare instances may have five. Usually the leaves and fixed separators are very similar in radial extents but this is only a matter of preference. The use of screws 56 to secure the small internal saddle strip portions 58 allows the movable saddle members 44 to be retained in the desired position without interference for and during operation.

It is, of course, realized that the inner support member 40 although shown as a one-piece tube, may be made of a grouping of components and need not have a through hole. This tubular configuration is conventional since it permits and encourages the use of a customer's drive means. The end caps 16 and 18 may be secured by through screws shown but not identified. Any other construction that permits repair may be utilized including adhesive. The formation of the grooves 42 for the resilient tubes 30 are usually longitudinally disposed but may be a spiral configuration. The saddle members 44 are carried so as to be retained in a groove and to rest on and be moved by the resilient tube. The drive members 48 are secured to the saddle members and are moved in response to the pressure in the resilient tube. The leaf members 20 are moved to their outer limit to provide the shoulder guide means of shallow grooves 26 before the drive members 48 effectively engage the inner diameter of the core.

The inlet conductor 28 may be of any configuration and is merely a matter of design convenience. The resilient tube may be of rubber, plastic or combinations thereof. The tubing is conventionally round but other shapes may be provided. The leaf member 20 and the flat saddle strip segments 58 are shown as separate members but may be made as one piece. The button-like drive members 48 are shown and contemplated as removable and replaceable but this is not to preclude the making of the saddle pieces and the drive member as a fixed assembly. The Applicant is required to illustrate his best mode at the time of invention and this he has done. Modifications and changes to accommodate particular conditions may and often do require changes within the limit of the supplying manufacturer. There are shown two button-like drive members 48 carried by each saddle member 44. This is not to preclude using only one drive member with each saddle member but may use as many as four or six drive members with each saddle. Button-like heads are shown on the driving members but other shapes may be provided. The essence of the invention is providing a saddle member which is moved by the expansible tube to drive a core and wind the narrow strip thereon. The saddle member positively moves the drive member outwardly to provide the desired drive tension and provide control of build-up tension and slip of the core.

The drive member is described as having a button head which is the hardware identification of a rivet or screw. This identification refers to a head that is substantially a spherical segment but other conformations may be used such as round or oval heads. A countersink in the saddle member to accept such head structures may also be provided. The drive member may also have no head since the drive member need only be independently movable of and along the leaf member. In such an arrangement the head and shank immediately under the head end may be substantially the same diameter. Round shanks on the drive member are contemplated since the formation of the circular aperture in the movable leaf members are the most economically manufactured but other shapes may be provided.

It is to be noted that the movable leaf 20 is retained by the mating edge portions 34 and 36 which are designed to allow outward guiding retention. The edge portions are not disposed radially but parallel to provide slidable confines. The retention of the movable leaf member can be by screws disposed in a parallel condition and secured to and in the inner member as by threaded holes.

Terms such as "left", "right", "up", "down", "bottom", "top", "front", "back", "in", "out" and the like are applicable to the embodiment shown and described in conjunction with the drawing. These terms are merely for the purposes of description and do not necessarily apply to the position in which the chuck for simultaneously winding a plurality of narrow product strips on cores may be constructed or used.

While a particular embodiment of the chuck has been shown and described it is to be understood the invention is not limited thereto and protection is sought to the broadest extent the prior art allows.

What is claimed is:

1. A chuck for winding strip material of narrow width on narrow cores carried and rotated by said chuck with the build-up of said strip windings on the core accommodated by slip provided by the chuck, said chuck being expanded locally by pressurized air or fluid means, the assembly of this chuck including:

(a) an inner support member having and providing an outer support surface;

(b) front and rear end caps and means for retaining said caps to the inner support member;

(c) a plurality of fixed separators adjacent to and carried by the inner support member and extending between said end caps providing thereby a minimum diameter over and along which the narrow cores may be slid;

(d) a plurality of movable leaf members interposed between the fixed supports, said leaf member in the retracted condition and position having an outward diameter providing a minimum diameter over and along which the narrow cores may be slid and positioned;

(e) a plurality of grooves of determined width and depth formed in the movable leaf member, and when said leaf members are moved to an outward condition each groove provides restraining shoulders sufficient to prevent unwanted movement of a narrow core along the chuck;

(f) cooperative means formed on the fixed separators and the movable leaf members to limit the outward movement of said movable leaf members;

(g) a plurality of tube retaining grooves formed in the inner support member with at least one groove disposed below each movable leaf member and positioned adjacent and outwardly from the groove formed in the movable leaf member;

(h) a resilient tube carried in each retaining groove, said resilient tube adapted for expansion to determined limits by an input of pressurized air or fluid;

(i) a plurality of saddle members carried in each tube retaining groove and movable outwardly and inwardly with the expansion and contraction of said tube;

(j) at least one drive member carried by each saddle member and movable with said saddle member so as to move the drive member into engagement with the inner diameter of a narrow core;

(k) spacing means to provide guide segments carried by each movable leaf member and to provide retaining guides for the saddle members, and (l) inlet means providing a conductor for carrying pressurized air or fluid to and from the resilient tubes, whereby the pressurized air or fluid is fed to said resilient tube so that the movable leaf members and drive members carried therewith are moved outwardly to provide restraining shoulders and drive means for each narrow core, reduction and release of the pressure on said resilient tube allows the leaf members and drive members to move to a condition and position whereat each narrow core may be removed from the chuck and replaced.

2. A chuck for winding strip material as in claim 1 in which the inner support is cylindrical and the end caps are removably attached to the assembly.

3. A chuck for winding strip material as in claim 2 in which one of the end caps has an inlet conductor adapted to receive and retain an external conductor of pressurized air or fluid connected to said inlet.

4. A chuck for winding strip material as in claim 3 in which there is only one tube and said tube is arranged in a serpentine manner to lay in substantially parallel grooves with intermediate portions having a U-bend except for the terminal end which is closed to flow.

5. A chuck for winding strip material as in claim 1 in which the fixed separators are attached to the inner support member and each longitudinal edge of the separator is shaped to provide an outwardly extending lip portion at and along the outer diametrical surface.

6. A chuck for winding strip material as in claim 5 in which each leaf member is formed with each longitudinal edge having an inner lip portion that extends outwardly and said lip portion is slidable along a mating longitudinal recess formed in said fixed separators.

7. A chuck for winding strip material as in claim 1 in which the drive member is a headed member with a reduced diameter shank portion removably seated in an aperture formed in the saddle member.

8. A chuck for winding strip material as in claim 7 in which the head end of the drive member is substantially a spherical segment and the shank is made with a reduced diameter end portion, said head made with at least a hardened outer surface.

9. A chuck for winding strip material as in claim 8 in which the drive member is of steel.

10. A chuck for winding strip material as in claim 8 in which each leaf member is formed with a shallow counterbore or counterbores, each sized and disposed to accept and receive the head of a drive member.

11. A chuck for winding strip material as in claim 1 in which a groove for receiving and retaining the resilient tube is substantially parallel and longitudinally arrayed and there is at least one groove and tube portion disposed below each movable leaf member.

12. A chuck for winding strip material as in claim 1 in which the saddle member is substantially as long as the width of the shallow grooves formed in the leaf members to receive and retain the narrow cores.

13. A chuck for winding strip material as in claim 12 in which each saddle member carries at least two drive members and there is also provided more than two leaf members.

14. A chuck for winding strip material as in claim 12 in which the spacing means between saddle members is a plurality of saddle strip segments secured to each movable leaf member.

15. A chuck for winding strip material as in claim 1 in which the inner core and end caps of said chuck are formed with a through passageway allowing removal and installation on a customer's drive means.

* * * * *